United States Patent [19]

MacKenzie

[11] Patent Number: 4,999,753

[45] Date of Patent: Mar. 12, 1991

[54] PORTABLE SAFETY DEVICE

[75] Inventor: Robert MacKenzie, Marion Bridge, Canada

[73] Assignee: Bay Industrial & Mine Tech Inc., Canada

[21] Appl. No.: 468,364

[22] Filed: Jan. 22, 1990

[30] Foreign Application Priority Data

May 24, 1989 [CA] Canada ..... 600539

[51] Int. Cl.[5] ..... F21V 33/00

[52] U.S. Cl. ..... 362/234; 362/108; 362/276; 362/800; 362/802

[58] Field of Search ..... 362/800, 806, 802, 103–108, 362/276, 234; 351/82, 149

[56] References Cited

U.S. PATENT DOCUMENTS

| | | | |
|---|---|---|---|
| 4,298,869 | 11/1981 | Okuno | 362/800 |
| 4,451,871 | 5/1984 | Kirkley et al. | 362/800 |
| 4,523,258 | 6/1985 | Morse et al. | 362/108 |
| 4,709,307 | 11/1987 | Branom | 362/800 |
| 4,866,580 | 9/1989 | Blackerby | 362/800 |

FOREIGN PATENT DOCUMENTS

| | | | |
|---|---|---|---|
| 2098714 | 11/1982 | United Kingdom | 362/800 |

*Primary Examiner*—James C. Yeung

*Attorney, Agent, or Firm*—Eckert Seamans Cherin & Mellott

[57] ABSTRACT

A portable safety device for attracting visual attention, comprises an array of flashing light sources, comprising high intensity light-emitting diodes having a light output of at least 500 mcandela. The light sources are connected in series with a solid state flashing circuit and a power supply. The power supply comprises a high energy battery and current limiting means in series therewith. The current limiting means prevents the current supplied by the battery externally of the power supply from exceeding a predetermined safe value. The solid state flashing circuit is periodically switchable between a low resistance state wherein the voltage across the series arrangement of high intensity light-emitting diodes exceeds a threshold voltage thereof, and a high resistance state wherein the voltage across the series arrangement of high intensity light-emitting diodes falls below the threshold voltage. The high intensity light-emitting diodes flash brightly to provide a low current attention-attracting device visible at long range.

13 Claims, 2 Drawing Sheets

PORTABLE SAFETY DEVICE

FIELD OF THE INVENTION

This invention relates to a portable device for attracting visual attention, especially suited for use in potentially explosive environments, such as underground mines, but also useful for cyclists, joggers, pedestrians, children and the like.

BACKGROUND OF THE INVENTION

There are many situations where it is desirable to provide an object with a high degree of visibility. For example, pedestrians, cyclists and children are particularly vulnerable to vehicle accidents at night, especially on roads with no sidewalk. It is common practice for such persons to wear reflective clothing or arm bands, but these can only be seen when the person is sufficiently close to the oncoming vehicle for enough light to be reflected.

Sometimes people will carry a conventional flashlight, but this can often only be seen in one direction and generally portable flashlights have a short lifetime, which means that they soon start to fade and become less visible.

Problems also arise in industrial environments where visibility is obscured due to dust or darkness, such as in underground mines, open pit mines, construction sites and the like. In such environments, there is often a danger of personnel being run over or caught by moving machinery, and it is vitally important to make the machinery as visible as possible so as to give the personnel sufficient time to move out of its way.

In all these situations, the warning time for the person in danger or operator of the vehicle is of the essence. For example, in the case of a fast-moving vehicle, a fraction of a second can make the difference between life and death. A vehicle moving at 60 miles an hour covers about 30 meters in one second.

Strobe lights, such as are found near road works, are known. These generally require substantial amounts of power and are therefore not conveniently portable and cannot be left unattended for prolonged periods. They are also not suitable for attachment to personnel, largely as a result of their bulk and weight.

Devices with flashing lights are known. For example, one such device is described in U.S. Pat. Nos. 3,944,803 and 3,134,548. These devices are unsatisfactory because the incandescent bulbs they employ consume a large amount of power and they therefore have a short lifetime. When incandescent bulbs are periodically switched on and off their lifetime is considerably shortened.

An object of the present invention is to alleviate the aforementioned problems and provide a portable safety device with high visibility and longevity.

SUMMARY OF THE INVENTION

According to the present invention there is provided a portable safety device for attracting visual attention comprising an array of flashing light sources, wherein the light sources comprise a plurality of high intensity light-emitting diodes having a light output of at least 500 mcandela, and said light sources are connected in series with a solid state flashing circuit and a power supply, said power supply comprising a high energy battery and current limiting means in series therewith, said current limiting means preventing the current supplied by the battery externally of the power supply from exceeding a predetermined safe value, and said solid state flashing circuit being periodically switchable between a low resistance state wherein the voltage across the arrangement of high intensity light-emitting diodes exceeds a threshold voltage thereof, and a high resistance state wherein the voltage across the arrangement of high intensity light-emitting diodes falls below said threshold voltage, whereby said high intensity light-emitting diodes flash brightly to provide a low current attention-attracting device visible at long range.

The flashing circuit can consist of a low intensity light-emitting diode with an integrated circuit driver incorporated therein. The change in resistance of the low intensity light-emitting diode as it switches on and off, and therefore the change in voltage across its terminals, causes the high intensity diodes to switch in synchronism with it. This is a convenient low cost way of causing the high intensity light-emitting diodes to flash.

The battery is preferably in the form of a lithium battery with a pair of resistors arranged in parallel as the current limiting means. Ideally the current should be limited to a maximum of half an amp, which for a nine volt battery means that the combined resistance of the resistors has to be 18 ohms. The advantage of using two resistors in parallel, each having a higher resistance such that the parallel combination has a resistance of 18 ohms, is that if one resistor fails the other resistor is still able to provide current at a reduced level. In case of a short circuit, a half amp fuse is connected in series with the battery, which cuts off the power completely.

To make the device safe for use in explosive environments, the entire power supply can be encapsulated in epoxy resin and the complete device mounted in a rigid container with a window, which may be in the form of a lens, through which the light-emitting diodes are visible. The latter are preferably arranged in a line. It has been found that three such light sources arranged about half an inch apart are most effective at attracting attention.

Ideally the light output of the high intensity light-emitting diodes should be at least 2000 mcandela.

When carried by pedestrians, the safety device can be seen at a distance of approximately 1600 to 4000 feet, depending on the brightness of the light-emitting diodes and the environmental conditions. The minimum legal requirement for such devices is that a person be seen at 500 feet, which gives enough time for reaction and braking. The safety device can therefore exceed the minimum requirement by a factor of three to eight depending on the conditions. In tests, a device powered by one lithium battery has flashed continuously for over three weeks, and with normal intermittent use can last for six months or more.

BRIEF DESCRIPTION OF THE DRAWINGS

The invention will now be described in more detail, by way of example only, with reference to the accompanying drawings, in which.

DESCRIPTION OF THE PREFERRED EMBODIMENTS

Figure 1:
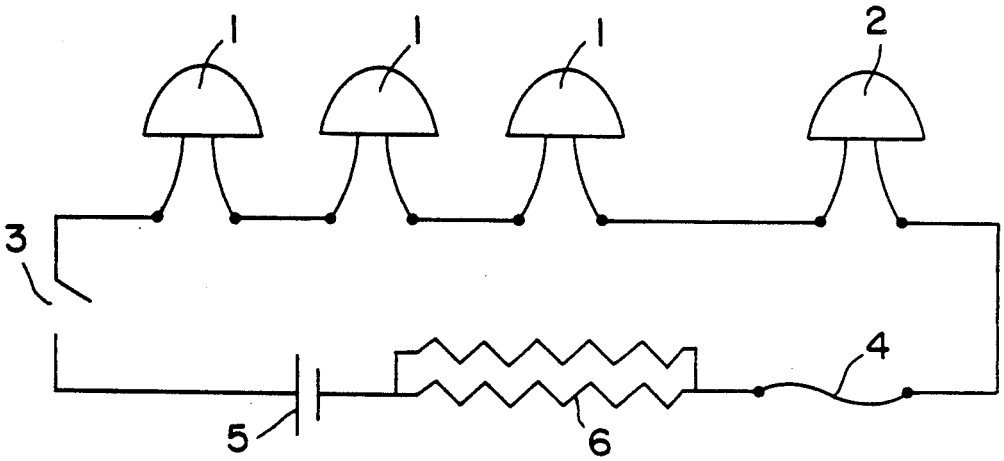
FIG. 1 is a schematic diagram of a safety device in accordance with the invention.

FIG. 1 shows three high intensity, super bright light-emitting diodes (LEDs) 1 with a 2000 mcandela light output, each having a rating of 1.85 volts at 20 m amps.

The LEDs 1 are connected in series with a standard low intensity, blinking light-emitting diode 2 incorporating a MOS integrated circuit driver and a red LED within a T-5 mm 1¾ inch plastic LED housing.

The LEDs 1 are supplied by the Tandy Corporation under product designation 276-087 TM and the LED 2 under product designation 276-036C TM.

The LEDs 1, 2 are connected in series through a switch 3 with a power supply consisting of a battery 5, comprising four 1.9 volt lithium batteries in parallel, a parallel pair of resistors 6, each having a 39 ohm resistance and 0.5 watt rating, and a 0.5 amp fuse 4.

The circuit is activated by closing switch 3. The internal integrated circuit causes the standard low intensity LED 2 to start flashing, and as it does so it changes from low to high resistance, and hence low to high voltage, causing the main voltage drop to be applied across the series arrangement of high intensity LEDs 1, which in turn are caused to turn on. The high intensity LEDs 1 therefore flash in synchronism with the low intensity LED2, even though the LEDs 1 do not incorporate internal drivers.

In the event of one of the resistors 6 becoming an open circuit, the remaining resistor limits the current to approximately half its previous value. While the intensity of light output falls, the safety device nonetheless continues to operate at an effective level. To ensure complete safety in the event of one or both of the resistors 6 becoming short circuited, the 0.5 amp fuse 4 is present.

The battery 5, consisting of four lithium batteries in parallel, parallel arrangement of resistors 6, and fuse 4 together make up the power supply. This is provided within a rigid metal or plastic box 12, completely sealed with epoxy resin such that the battery 5, resistors 6, and fuse 4 are fully encapsulated.

Figure 2:
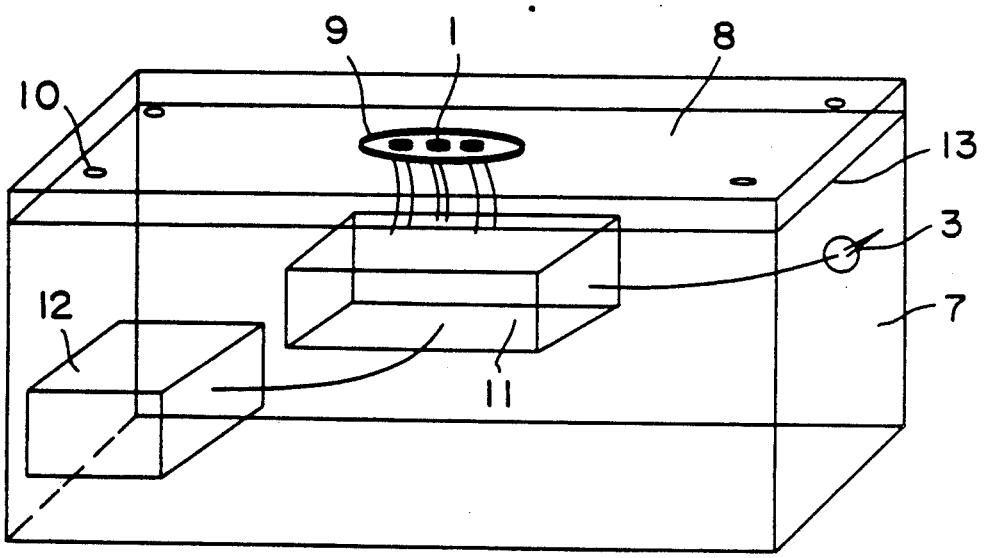
FIG. 2 is a illustration of a trip lamp for use in mines and similar environments.

Turning now to FIG. 2, the miner's trip lamp has a hermetically sealed steel or plastic casing 7 with a removable lid 8 bolted to the casing 7 by bolts 10 and sealed by means of a rubber seal 13.

The casing 7 contains the battery container 12 and a further steel or plastic box 11 in which is encapsulated the flasher unit consisting of the LED 2. The box 11 is mounted such that the high intensity LEDs 1 protrude therefrom and are mounted just below a plastic lens 9 sealed in the lid 8 of the casing 7. The three LEDs 1 are arranged in a line and spaced about half an inch apart.

The trip lamp shown in FIG. 2 is particularly adapted for use in explosive environments, such as underground mines and the like. The casing 7 is completely hermetically sealed and the flasher unit 2 is hermetically sealed inside the box 11, mounted within the casing 7, as is the battery pack mounted within the container 12. Since the flashing circuit is entirely solid state, there is no risk of spark generation, even though any such sparks generated would be sealed both within the containers 11 and 12 and the casing 7.

The safety device is therefore useful for placement in mine shafts and, for instance, on the front of underground vehicles.

Figure 3:
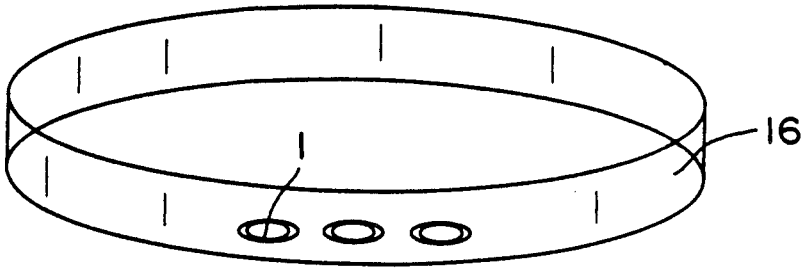
FIG. 3 is an illustration of a safety band incorporating a safety device in accordance with the invention.

FIG. 3 shows schematically an arm band or the like for use by pedestrians. The three light-emitting diodes 1 are mounted on the arm band and are connected by wires (not shown) to a lightweight battery pack (not shown) carried by the wearer. Since there is no risk of explosion, the battery power supply can be made very small and light. Although described as a lithium battery, other suitable batteries, such as alkaline or carbon-zinc batteries can be employed.

Figure 4:
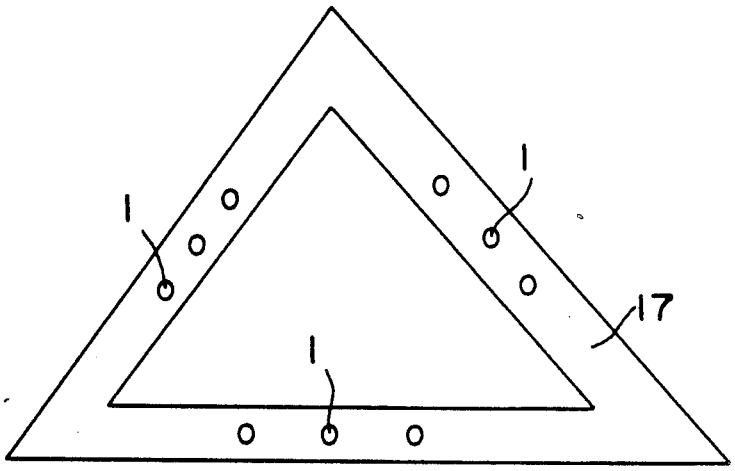
FIG. 4 is an illustration of a hazard warning triangle incorporating a safety device in accordance with the invention.

FIG. 4 shows a hazard warning triangle 17 with three rows of LEDs 1, one for each side of the triangle. Such a warning triangle is considerably more effective than the passive type, yet the safety device adds little to the overall weight and is reliable even after long periods of inactivity.

Such safety devices, when incorporated into articles of clothing, such as belts as shown in FIG. 3, or other types of articles such as protective vests and the like, can be of very great value in enhancing safety of personnel. The extremely high visibility is an obvious benefit, but also the ability to continue flashing for long periods with a light and portable power source is also of great significance.

There are many examples of situations where such a device can be usefully employed. Some have been already mentioned, but others are joggers, walkers, cyclists, hunters, fishermen, motorcyclists, snowmobilers, A.T.V.s, adventurers, climbers, skiers, and explorers.

In a professional environment, the devices can be used at traffic check points, for ambulance attendants, firemen, tow truck attendants, search and rescue personnel, forest and game rangers, E.M.O, police, sailors, oil rig personnel, freight and cargo handlers, linesmen, military personnel, utility works, miners, railway yard and terminal operators, trip lamps, airport traffic directors (commercial, private), military, parking lot attendants, offshore life-saving capsules, marine survival suits, hazardous and disabled vehicles.

The device can also be supplied to children's Halloween costumes to significantly enhance safety on Halloween.

The following is a comparative table of features of reflective devices, incandescent type devices and devices in accordance with the present invention.

TABLE 1

PRODUCT FEATURE COMPARISONS

| FEATURES | REFLECTIVE DEVICES | BULB TYPE | LED TYPE |
|---|---|---|---|
| DEVICE TYPE | PASSIVE | ACTIVE | ACTIVE |
| DAYTIME VISIBILITY | GOOD | N/A | N/A |
| NIGHTTIME VISIBILITY | POOR | GOOD | EXC |
| ADVERSE ENVIRONMENTS | POOR | GOOD | EXC |
| WATERPROOF | N/A | POOR | EXC |
| VIBRATION RESISTANCE | N/A | POOR | EXC |
| IMPACT RESISTANCE | N/A | POOR | EXC |

TABLE 1-continued

PRODUCT FEATURE COMPARISONS

| FEATURES | REFLECTIVE DEVICES | BULB TYPE | LED TYPE |
|---|---|---|---|
| VISIBILITY DISTANCE | 500 Ft. (DAY) | ½ mi (APPROXIMATELY) | ½-¾ mi |
| POWER SOURCE SIZE | N/A | LARGE | SMALL |
| POWER SOURCE WEIGHT | N/A | HEAVY | NEGLIGIBLE |
| PRODUCT/LONGEVITY/(CONT.) | N/A | 8 HOURS | 10 WEEKS |
| BULKINESS | CUMBERSOME | BULKY | NEGLIGIBLE |
| PRODUCT WEIGHT | NEGLIGIBLE | HEAVY | NEGLIGIBLE |

Abbreviation Legend:
N/A = Not Applicable
EXC = Excellent
Ft. = Feet
mi. = Miles
FREQ. = Frequently
CONT. = Continuously ON The safety device in accordance with the invention can be made completely waterproof, dustproof, shockproof and impact resistant very easily in view of the fact that there is a minimum number of parts and the integrated circuit is not susceptible to shock, especially when encapsulated in the stout container.

In the case of devices intended for attachment to articles of clothing, many methods of attachment can be employed, such as clips, tape, bolts, glue etc., and the device can be attached to almost any article of clothing, such as jackets, pockets, or helmets, or other equipment such as bicycles, or parked or stationary machinery.

One of the important features of the product is its ability to operate with very low power consumption at high intensity for long periods. The high intensity LEDs employed, while having a light output some 2000 times the output of a conventional low power LED, draw about the same current. In many cases, when the device is switched off while not in use, it can last many years before requiring a change of battery.

The number of components required for the device described is extremely low, and this low component count translates into extremely good reliability. In the preferred embodiment, the three light sources are arranged in a straight line about half an inch apart and flash in synchronism. This combination has been found to be most effective at attracting attention.

The described safety device has good penetration of rainy, snowy, foggy, smokey and dusty environments. The light is reflected off the microscopic particles in the air, producing a glow from the surrounding particles. This phenomenon is especially useful for firemen in a burning building, for example, where visual contact may be very short and only enhancement of lighting conditions is extremely useful.

High intensity light-emitting diodes have significant advantages over conventional bulbs. Incandescent bulbs are intolerant to flashing and can consume up to ten times the rate of current in the turn on phase. By contrast, LEDs consume very low current and when switched on consume even less. They are extremely tolerant of flashing, can have a life span of over 100,000 hours and be virtually shockproof and impact proof.

When applied to warning triangles on motor vehicles, LEDs have a significant advantage over flares, which deteriorate over time. Flares are susceptible to environmental conditions, such as wind, rain and snow, and they are not always dependable. Also, they can be dangerous, especially if someone inadvertently trips over one.

A particular application for the safety device is as a trip lamp for use in underground mines. A trip lamp is attached to the front of a train or vehicle that takes coal, material or personnel throughout the mine. The trip lamp gives notice to personnel that the vehicle is approaching. Conventional trip lamps with lead acid batteries last for only eight to ten hours, and in many cases replacement is so time-consuming that lamps have not been replaced due to the nuisance aspect, leading to unfortunate accidents.

I claim:

1. In a portable safety device for attracting visual attention comprising an array of flashing light sources, the improvement wherein said light sources comprise high intensity light-emitting diodes having a light output of at least 500 mcandela, and said light sources are connected in series with a solid state flashing circuit and a power supply, said power supply comprising a high energy battery and current limiting means in series therewith, said current limiting means comprising at least one resistor in series with a fuse, said high energy battery and said current limiting means being hermetically sealed and completely encapsulated in resin, said current limiting means preventing the current supplied by said power supply from exceeding a predetermined safe value, and said solid state flashing circuit being periodically switchable between a low resistance state wherein the voltage across the arrangement of high intensity light-emitting diodes exceeds a threshold voltage thereof, and a high resistance state wherein the voltage across the arrangement of high intensity light-emitting diodes falls below said threshold, whereby said high intensity light-emitting diodes flash brightly to provide a low current attention-attracting device visible at long range.

2. A portable safety device for attracting visual attention as claimed in claim 1, wherein said solid state flashing circuit comprises a low intensity light-emitting diode with an integrated circuit driver incorporated therein, said low intensity light-emitting diode being in the low resistance state when on and thereby causing said high intensity emitting diodes to come on with it.

3. A portable safety device for attracting visual attention as claimed in claim 1, wherein said battery comprises at least one lithium battery.

4. A portable safety device for attracting visual attention as claimed in claim 1, wherein said current limiting means includes a pair of resistors arranged in parallel.

5. A portable safety device for attracting visual attention as claimed in claim 4, and especially adapted for use in explosive environments, wherein said power supply including said current limiting means is hermetically sealed in a rigid container.

6. A portable safety device for attracting visual attention as claimed in claim 5, wherein said power supply is embedded in epoxy resin.

7. A portable safety device for attracting visual attention as claimed in claim 6, comprising a rigid sealed casing containing said power supply, light-emitting diodes and flashing circuit, said casing having a window on at least one face thereof through which said light-emitting diodes are visible.

8. A portable safety device for attracting visual attention as claimed in claim 7, wherein said window is in the form of a plastic lens.

9. A hazard warning triangle incorporating a device as claimed in claim 1 and having said high intensity light-emitting diodes mounted on a reflective surface thereof.

10. An article of clothing incorporating a device as claimed in claim 1 and having said high intensity light-emitting diodes mounted thereon.

11. A portable safety device for attracting visual attention as claimed in claim 1 wherein said high intensity light-emitting diodes are arranged in a line.

12. A portable safety device for attracting visual attention as claimed in claim 1, wherein said high intensity light-emitting diodes have a light output of at least 2000 mcandela.

13. A portable safety device as claimed in claim 1 wherein said array comprises a line of three high intensity light-emitting diodes.

* * * * *